United States Patent [19]

Rodler, Jr.

[11] Patent Number: 4,993,977

[45] Date of Patent: Feb. 19, 1991

[54] WATER JET PROPULSION MODULE

[75] Inventor: Waldo E. Rodler, Jr., San Jose, Calif.

[73] Assignee: FMC Corporation, Chicago, Ill.

[21] Appl. No.: 369,179

[22] Filed: Jun. 21, 1989

[51] Int. Cl.[5] ..... B63H 1/16

[52] U.S. Cl. ..... 440/67; 415/189

[58] Field of Search ..... 440/5, 6, 7, 38, 49, 440/40, 43, 47, 66, 67, 71, 72; 415/213 C, 63, 66, 182, 185, 196, 197, 214.1, 218.1, 219.1, 220, 221, 227, 228; 60/221

[56] References Cited

U.S. PATENT DOCUMENTS

| | | | |
|---|---|---|---|
| 3,030,909 | 4/1962 | Barnes et al. | 115/12 |
| 3,174,454 | 3/1965 | Kenefick | 115/16 |
| 3,192,715 | 7/1965 | Engel et al. | 60/35.55 |
| 3,212,258 | 10/1965 | Gongwer | 60/35.54 |
| 3,214,903 | 11/1965 | Cockran | 60/35.5 |
| 3,283,737 | 11/1966 | Gongwer | 115/16 |
| 3,306,046 | 2/1967 | Trapp | 60/222 |
| 3,336,752 | 8/1967 | Smith | 60/221 |
| 3,357,389 | 12/1967 | Wray, Jr. | 114/66.5 |
| 3,420,204 | 1/1969 | Samuel | 115/1 |
| 3,476,070 | 11/1969 | Austen | 440/67 |
| 3,495,407 | 2/1970 | Davis | 60/222 |
| 3,575,127 | 4/1971 | Wislicenus | 115/12 |
| 3,809,005 | 5/1974 | Rodler, Jr. | 115/12 |
| 4,073,257 | 2/1978 | Rodler, Jr. | 115/12 |
| 4,427,393 | 1/1984 | May | 440/67 |
| 4,637,801 | 1/1987 | Schultz | 440/67 |
| 4,864,959 | 9/1989 | Takamizawa et al. | 440/6 |

FOREIGN PATENT DOCUMENTS

| | | | |
|---|---|---|---|
| 1387903 | 11/1963 | France | 440/67 |
| 1492084 | 4/1966 | France . | |

OTHER PUBLICATIONS

Single undated drawing illustrating a Berkely Pump Jet Drive.

An Aerospace Engineeering Article by Stuart Birch dated Apr. 18, 1989 (p. 41).

An Aerospace Engineering Article dated Feb. 1989, illustring several Ram Jet Engines (p. 10).

*Primary Examiner*—Joseph F. Peters, Jr.

*Assistant Examiner*—Clifford T. Bartz

*Attorney, Agent, or Firm*—A. J. Moore; R. C. Kamp; R. B. Megley

[57] ABSTRACT

A water jet propulsion module is generated about a central axis and has an inlet opening and a discharge opening concentric with said axis. The module includes a stator having an inner wall and an outer wall with curved stator vanes connected between said inner and outer walls. An impeller shroud is adjustably connected to the outer stator wall. A motor secured to the stator drives a planetary gear drive attached to an impeller by a parabolic impeller cone. The impeller draws water into the inlet opening and drives the water past the stator vanes out of the discharge opening along a substantially linear path at high speed and pressure.

20 Claims, 3 Drawing Sheets

FIG_1
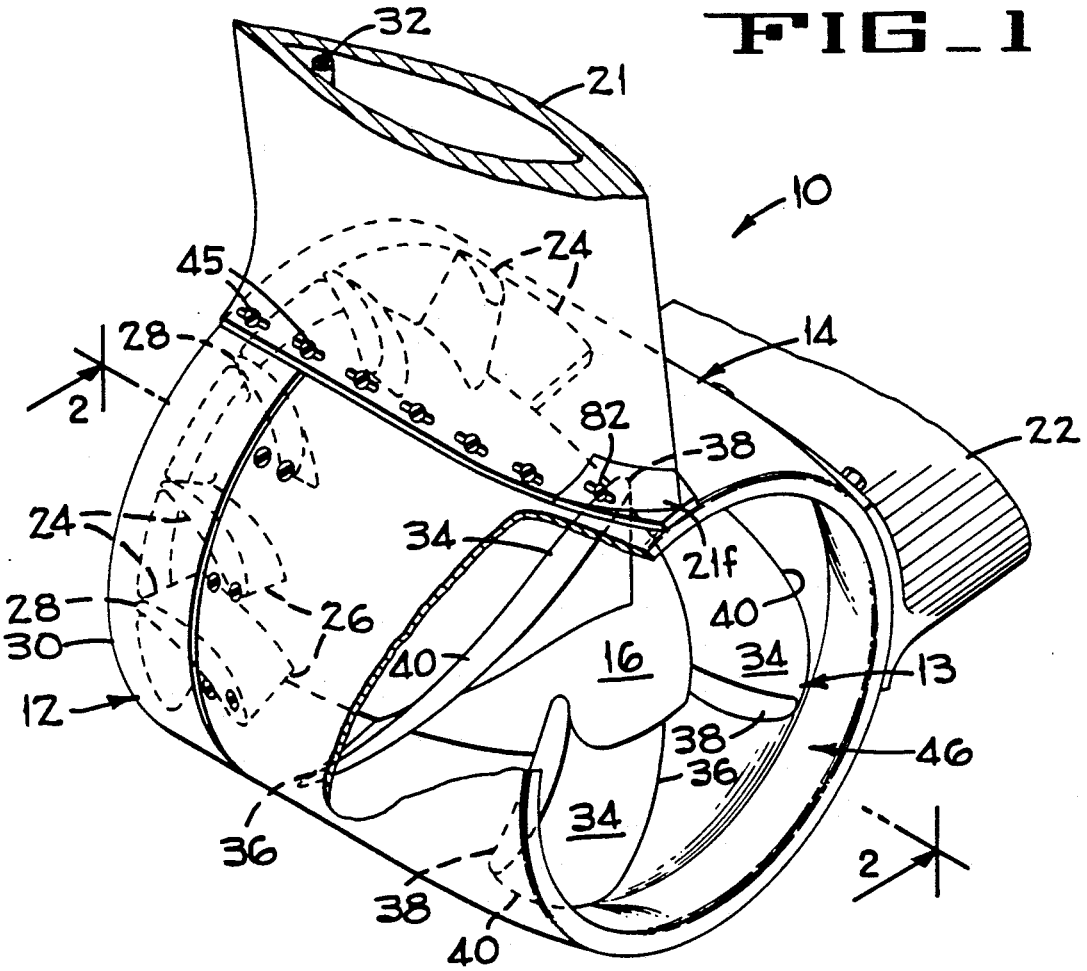
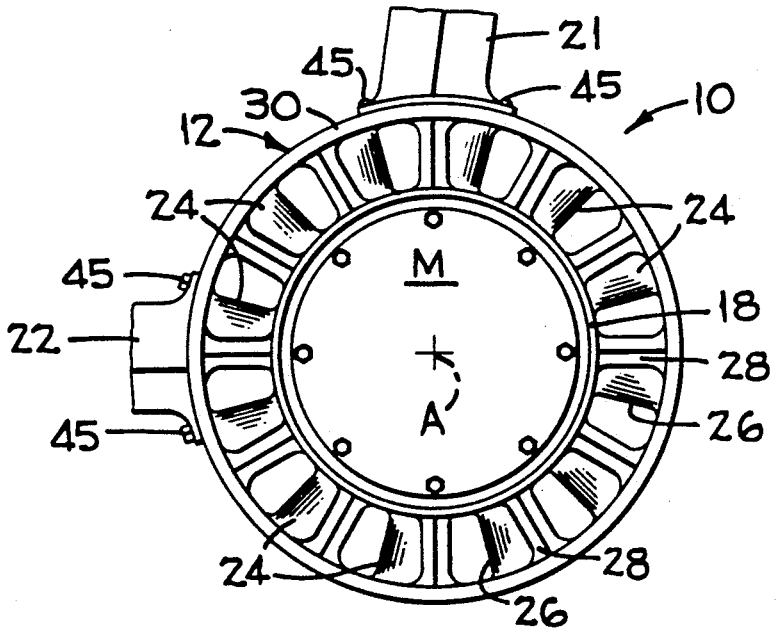
FIG_3

FIG_4
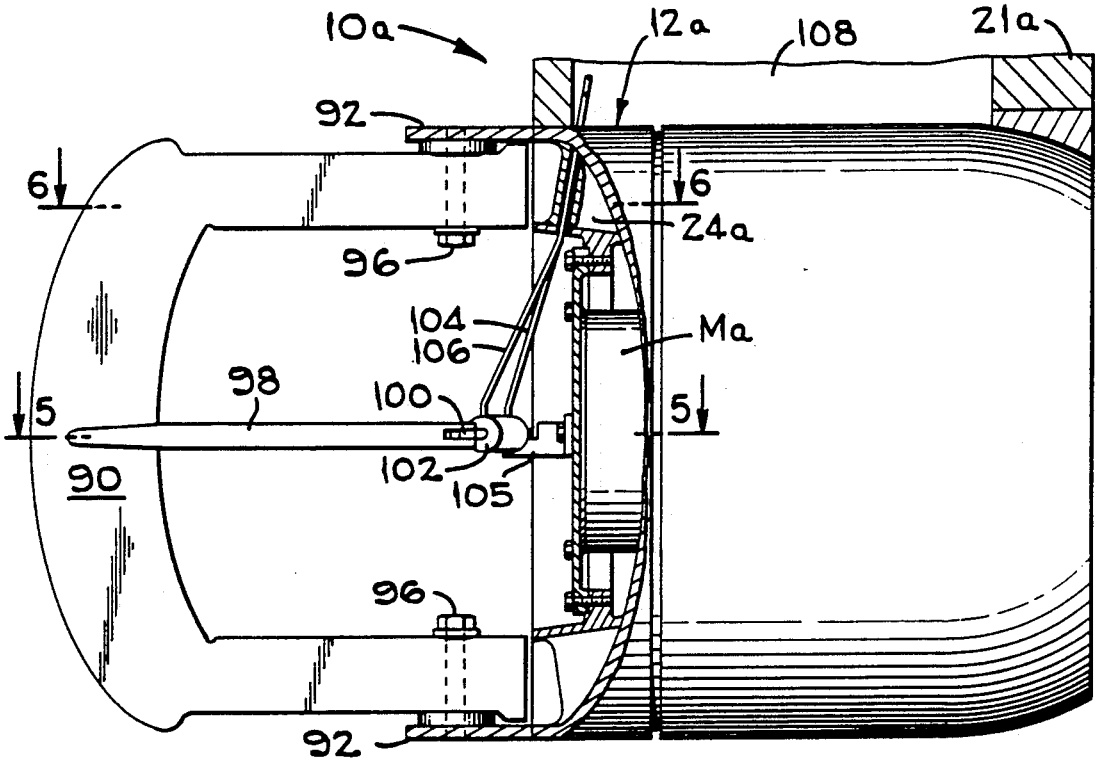
FIG_5
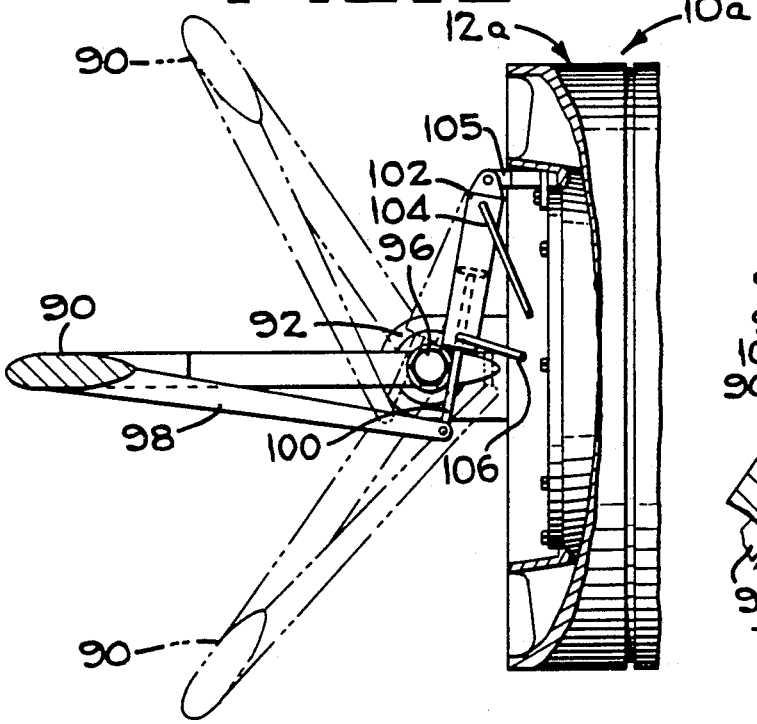
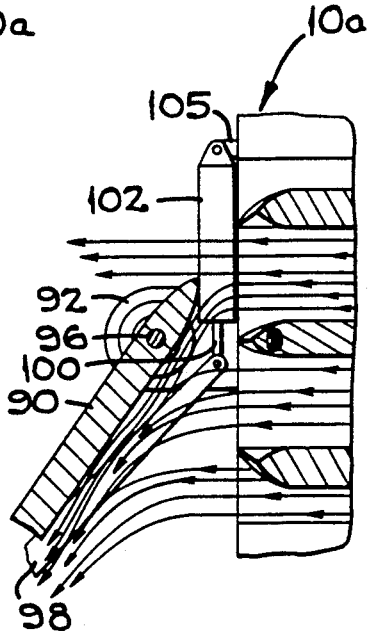
FIG_6

WATER JET PROPULSION MODULE

BACKGROUND OF THE INVENTION

1. Field of the Invention

The present invention relates to water jet propulsion modules and more particularly relates to a short inline annular module that is concentric with the axis of an impeller which directs water between parallel inlet and outlet openings through an annular duct which gradually reduces in size to discharge the water at the velocity that provides the maximum propulsive efficiency by maximizing the product of "Ideal Efficiency" and "Pumping Efficiency".

2. Description of the Prior Art

Assignee's Samuel U.S. Pat. No. 3,420,204 discloses a water jet reactive propulsion system which is designed to propel tracked amphibious military vehicles through water.

Rodler, Jr. U.S. Pat. Nos. 3,809,005 and 4,073,257 discloses two versions of jet propulsion systems of novel design wherein the water intake duct and the water discharge duct are connected by passageways which require approximately two 180° reversals of direction of the propulsion water and provide a propulsion efficiency of about 20% higher than conventional water jets.

Conventional water jets are illustrated in Kenefich 3,174,454 and Trapp 3,306,046 wherein the water enters the water jet through a substantially horizontal opening and is discharged through a substantially vertical opening. The major disadvantage of the conventional water jets is their relatively low propulsive efficiencies. The power input to water jets is distributed to the following areas:

1. Inlet drag
2. Internal flow losses
3. Kinetic energy lost in the jet discharge
4. Useful power output The inlet drag is related to the square of the hull speed of a watercraft and is relatively negligible at speeds below 20 miles per hour but is a major factor in performance at high speeds.

Internal flow losses, such as inlet duct losses, impeller losses, stator losses, nozzle losses and steering losses in general relate to the square of the flow. Flow is primarily a function of power input and nozzle size. For a given application, increasing flow and decreasing pressure by use of a large nozzle will increase losses in this area. Said internal flow losses decrease the critical Pumping Efficiency. "Pumping Efficiency" is found by:

$$\text{Pumping Efficiency} = \frac{\text{(Hydraulic Power Output)}}{\text{(Mechanical Power Input)}}$$

Kinetic energy losses occur because the water starts in a static condition, but it is discharged from the water jet nozzle at a high velocity. The water jet thrust results from the reaction forces when this water is accelerated. The substantial kinetic energy in this high velocity water is an irrecoverable loss. "Ideal Efficiency" is used to qualify losses in this area. It is found as follows:

$$\text{Ideal Efficiency} = 2 \times \text{Hull Speed}/(\text{Hull speed} + \text{Jet speed.})$$

At any hull speed this equation shows that Ideal Efficiency can be improved only by decreasing Jet Speed.

Decreasing jet speed requires greater flow to maintain a specific amount of thrust. Since the internal flow losses increase with increased flow, a careful trade off is required to optimize "Propulsive Efficiency" by maximizing the product of "Pumping Efficiency" and "Ideal Efficiency" while minimizing inlet drag by improved hydraulic design and minimized inlet area.

SUMMARY OF THE INVENTION

The water jet propulsion module of the present invention include a two piece annular outer housing including an inlet opening and a substantially parabolic inner surface which blends into a cylindrical surface and is adjustably connected to a cylindrical outer wall of a stator housing. The stator housing includes a frustoconical inner wall and has a plurality of water straightening stator vanes therein and defines a narrow outlet opening. An impeller with a parabolic diffusion cone, a two stage planetary gear drive, and a motor are disposed within the housings and are concentric with the axis of the housings. When submerged in water and supported by a water born watercraft, water is forced through the inlet opening by the combined forces of net positive static head (atmospheric pressure+static head−vapor pressure) and velocity head from any forward motion of the craft. Upon reaching the rotating impeller blades, vortex flow is induced to increase the total head (total head=static head+velocity head), which reaches a maximum value at the impeller discharge. As the water continues through the stator, streamlined blades are used to convert the tangential flow component of the impeller discharge vortex into pure axial flow. The convergent walls of the stator produce a decreased flow area that by laws of continuity of flow causes the fluid velocity to increase. As the fluid reaches the combined Stator Discharge and Annular Nozzle, the total head at the impeller discharge, minus atmospheric pressure and the minor stator losses, is converted into the desired velocity head.

BRIEF DESCRIPTION OF THE DRAWINGS

FIG. 1 is a perspective of the water jet propulsion module with parts cut away, and with fragments of module supporting components attached thereto.

FIG. 3 is a rear view looking into the discharge end of the module illustrating curved stator vanes.

FIG. 4 is a side elevation with parts cut away of a second embodiment of the invention illustrating a steerable rudder.

FIG. 5 is a section taken along lines 5—5 of FIG. 4 illustrating a hydraulic cylinder for actuating the rudder.

FIG. 6 is a diagrammatic section taken along lines 6—6 of FIG. 4 illustrating the water flow engaging the rudder.

DESCRIPTION OF THE PREFERRED EMBODIMENT

Figure 2:
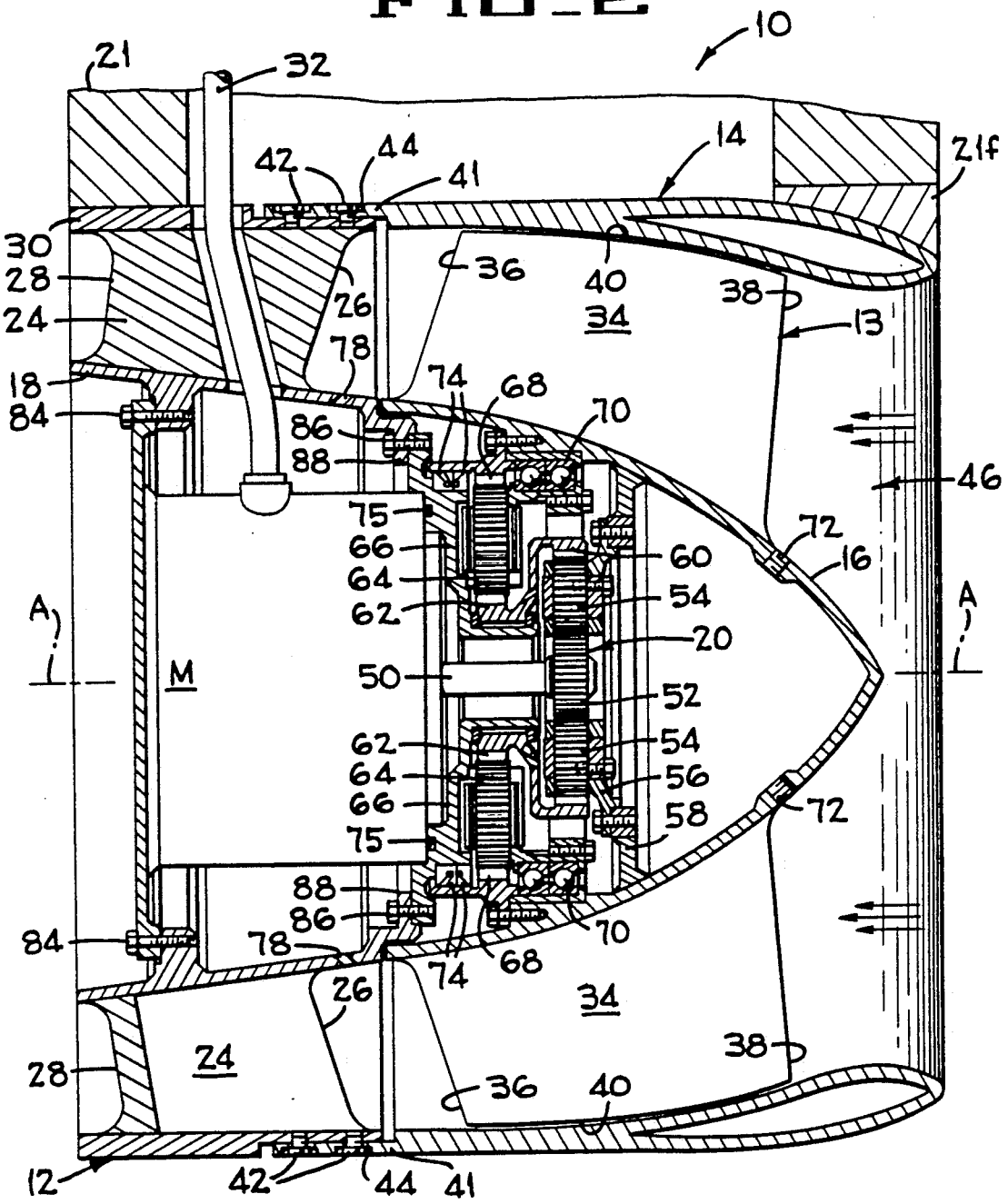
FIG. 2 is a vertical section taken along lines 2—2 of FIG. 1 with the impeller blades diagrammatically illustrated to show their forward and rear edges.

Prior to describing the apparatus of the present invention it is believed that it would be helpful to define and indicate how the "propulsive efficiency" of the present water jet propulsion module 10 (FIGS. 1—3) is maximized.

The water starts in a static condition, but it is discharged from the water jet nozzle at a high velocity. The water jet thrust results from the reaction force when this water is accelerated. The substantial kinetic energy in this high velocity water is an irrecoverable loss. "Ideal Efficiency" is used to quantify losses in this area. It is found as follows:

$$\text{Ideal Eff.} = 2 \times \text{Hull Speed} / (\text{Hull speed} + \text{Jet speed})$$

The ideal efficiency can be improved only by decreasing the jet speed which requires greater flow to maintain a specific amount of thrust. Since internal flow losses increase with the increased flow, a careful tradeoff is required to maximize propulsive efficiency. The water jet propulsion module of the present invention is specifically designed to provide such desired efficiency by minimizing the internal wetted area of the fluid path. Said reduction of area reduces the viscous losses which are a function of wetted area.

The water jet propulsion module 10 (FIGS. 1 and 2) in general comprises a stator housing 12; an impeller 13 within an impeller shroud 14 that is removably connected to said stator housing 12; a rotatable, generally parabolic impeller diffusion cone 16 within the impeller shroud 14 and leading into an inner wall 18 of the stator housing 12. A motor M is rigidly secured to the inner stator housing wall 18 and is coupled to a speed reducing planetary gear drive 20 that is disposed within and has its output secured to the inner surface of the impeller diffusion cone 16. All of the above components are concentric with an axis A of the motor M, and the module 10 is preferably connected to a hollow supporting member 21 and to a water engaging hydrafoil 22 or the like for support by a watercraft (not shown).

More particularly, the stator housing 12 (FIG. 2) includes a plurality of stator vanes 24, 12 vanes being illustrated, which are curved as best shown in FIG. 1 for receiving the water from the impeller 13. The vanes 24 have thin leading edges 26 and trailing edges 28 that are flared into and rigidly secured to the inner wall 18 and an outer wall 30 of the stator housing as best shown in FIGS. 1–3.

The curved streamlined shaped stator vanes serve to prevent the water driven by the impeller from discharging from the module 10 as a vortex. As shown in FIG. 2, one or more of the stator vanes are thickened and ported to receive one or more power and control circuits 32 leading to the power means such as the motor M. The motor M may be either electrically or hydraulically driven.

The generally parabolic impeller housing or diffusion cone 16 has a plurality of impeller blades 34 thereon, each of which includes a trailing edge 36, a leading edge 38, and are of generally air foil shape as illustrated in FIG. 1. Each blade has an outer edge 40 which lies closely adjacent to the parabolic inner surface of the impeller shroud 14 as shown in FIG. 2. It will be noted that the impeller blades 34 (FIG. 1) are relatively straight to minimize restriction or choking in the blade cascade thus minimizing internal flow losses.

A connecting portion 41 (FIG. 2) of the impeller shroud 14 is of reduced thickness and is adjustably received in a reduced diameter portion of the stator housing 12 by a plurality of cap screws 42 which extend through slots 44 (FIG. 2) in the impeller shroud and are screwed into the threaded holes in the outer wall 30. Similarly, slots and cap screws 45 are provided to connect the supporting member 21 (FIG. 1) and the hydrafoil 22 to the stator housing 12. Thus, if the outer edges 40 of the impeller blades wear due to the presence of abrasives such as sand or the like in the water, the impeller shroud may be moved axially rearwardly relative to the stator housing 12 to provide a suitable spacing between the outer impeller edges 40 and the inner surface of the stator housing.

As illustrated in FIG. 2, the forward end portion of the annular water jet module 10 is double walled to reduce weight and to provide an inwardly curved outer wall with a rounded forward end which is integral with an inwardly and rearwardly curved portion that thereafter angles radially outwardly and communicates with a cylindrical surface of the outer stator wall 12. The above described surfaces are made as smooth as possible to minimize turbulence and drag.

The adjacent surfaces of the impeller diffusion cone 16, the inner wall 18 of the stator 12, the inner surface of the impeller shroud 14 and the inner surface of the outer wall 30 of the stator housing define an annular duct 46 of continuously increasing inside diameter, and continuously decreasing interior cross section from the inlet to the outlet end of the module 10. The above configuration results in gradually increasing the speed of the water as it moves through the annular duct 46 thereby discharging the water at high velocity from the rear end of the module.

The motor M is preferably an alternating current AC motor, or a brushless DC motor, having a rating of about 350 horse power at 15,000 rpm which drives the impeller at about 1130 rpm. Thus, the planetary gear drive 20 has a 12.26 to 1 speed reduction. The impeller efficiency is between about 81–91%. Alternately, a hydrostatic motor of the same horse power may be substituted for the electric motor.

It will, of course, be understood that other sizes of motors may be used for different sizes and types of watercraft.

The two stage planetary gear drive 20 (FIG. 2) is driven by an output shaft 50 of the motor M. A drive gear 52 is splined to the shaft 50 and meshes with a plurality of first stage planet gears 54 with needle bearings and thrust washers. The planet gears 54 are journaled in an annular support ring 56 that is bolted to a flange 58 secured to the inner surface of the impeller diffusion cone 16. The planet gears 54 mesh with a first stage ring gear 60 which is integrally formed with a second stage sun gear 62. The second stage sun gear meshes with a plurality of second stage planet gears 64 that are journaled in an annular bracket 66 bolted to the inner wall 18 of the stator housing 12. The second stage planet gears 64 mesh with a second stage ring gear 68 that is bolted to the impeller diffusion cone 16. The diffusion cone 16 is journaled to the annular bracket 66 and non-rotatable stationary housing 18 by a plurality of angular contact ball bearings 70.

The two stage planetary gear drive 20 is lubricated by oil which is added or drained from the diffusion cones through ports closed by plugs 72. The oil is filled to a depth equal to the level of the lower fill plug 72 and remains at approximately that level at low speeds. At high speeds centrifugal force will hold the oil in a ring thrown against the interior of the diffusion cone 16. The inner surface of the oil ring will be outwardly of the axes of the planetary gears 64. Oil can be directed where needed by use of an impact tube or by other known methods (not shown). Annular lip seals 74 and an O-ring 75 are provided to prevent water from entering the planetary gear drive 20. Fluid flow passages 78 are provided in the stator housing 12 to permit water to circulate about the motor M to cool the motor M.

The O-ring 75 has a safety factor of at least 15 over the highest pressure acting on the O-ring. Bleed holes (not shown) help reduce pressure on the critical dynamic lip seal 74 and reduce thrust loads on bearings 70.

In order to move the impeller shroud 14 (FIG. 2) over the impeller 16 for repairing or removing the impeller, a removable transition fairing **21*f* of the support member 21 is provided and is removably connected by cap screws and slots 82 (only one being shown in FIG. 1. Thus, removal of the transition fairing 21*f* and the cap screws 82 (FIG. 1) will permit the impeller shroud 14 to be removed to the right (FIG. 2) over the impeller 13**.

The hydrofoil 22 is preferably unbolted from the stator housing 12 and impeller shroud 14 before removal of the impeller shroud 14 from its operative position over the impeller. However, if desired, the hydrafoil 22 (FIG. 1) and impeller shroud 14 may be removed as a unit by removing the fairing **21*f* and cap screws 82 (FIG. 1**).

After the impeller shroud 14 has been removed, the power and control circuits 32 are released from the waterproof motor M (FIG. 2), and cap screws 84 are removed allowing the motor M and its splined shaft 50 to be removed from the drive gear 52 and the stator housing 12. Cap screws 86 are then removed allowing the impeller 13 to be removed by being pulled to the right (FIG. 2) out of engagement with an annular ring 88 of the stator housing 12. After repairs are made to the impeller, and/or the two stage planetary gear drive 20, the assembly procedure is the reverse of the above.

Figure 2A:
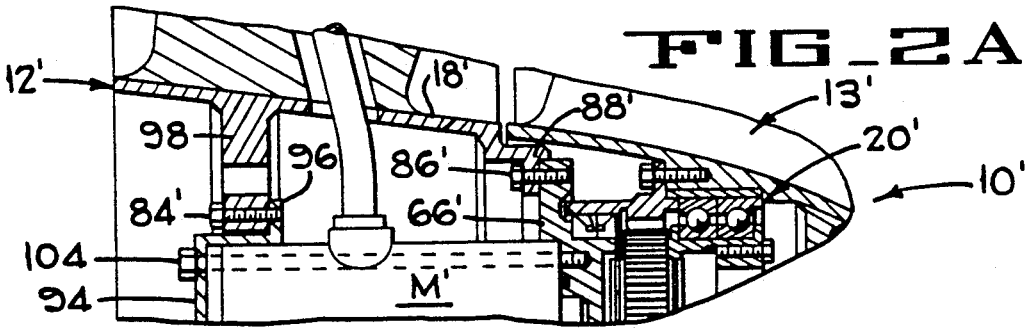
FIG. 2A is a modified vertical section similar to a portion of FIG. 2 but illustrating components arranged to allow removal and assembly of a motor, a planetary gear drive, and an impeller as a unit onto a stator housing.

An alternate and preferred way of mounting the motor M', (FIG. 2A) to the two stage planetary gear drive 20', and the impeller 13' to the inner wall 18' of the stator housing 12' is as illustrated in FIG. 2A which permits the entire drive assembly including the motor M', the planetary gear drive 20', and the impeller 13' to be removed as a unit from the stator housing 12' out of the water inlet end of the water jet propulsion module 10' after the impeller shroud has first been removed thus avoiding contamination of these precision parts during field service and facilitating depot repair.

The FIG. 2A embodiment differs from the FIG. 2 embodiment in that a rear motor mounting plate 94 includes an annular flange 96 which is connected to the forward side of an internal ring 98 of the stator housing 12' by a plurality of cap screws 84' (only one being shown). The inner wall of the stator 12' also includes an inner annular ring 88' which is bolted to the rearward surface of an annular bracket 66' by a plurality of cap screws 86' (only one being shown) in the ring 88'. Thus, removal of the cap screws 86' by a long socket wrench, and removal of the cap screws 84' will allow the motor M', the two stage planetary gear drive 20' and the impeller 13' to be removed as a unit from the stator housing 12'. A plurality of elongated through studs 104 (only one being shown) connect the motor M' to the annular bracket 66'.

Two 350 horse power AC induction motors or sealed DC brush motors are suitable for propelling an amphibious tracked military vehicle weighing 30 tons at a speed of about 20 miles per hour when two water jet propulsion modules are used and hydrafoils are connected to the vehicle and are a size which provides 15 tons of lift.

The axial water passage through the water jet module 10 (FIG. 2) allows reverse thrust by reversing the direction of rotation of the impeller 13. When reversing the impeller, suction head losses occur and cavitation limits the water flow rate. Under these circumstances the reverse thrust will be limited to about 20% of the maximum forward thrust. This value is adequate to develop normal speeds for reverse operation and is comparable to the reverse thrust developed by bucket deflectors used on conventional water jets. Elimination of bucket reversing deflectors used on conventional water jets provides a smoother exterior surface of the module thereby minimizing external drag caused by the water flowing externally of the water jet module.

When two water jet propulsion modules 10 are used to propel a vehicle, steering the vehicle can be accomplished by driving the two impellers 13 at different speeds. Slow speed steering may be accomplished by reversing the direction of one of the two motors.

FIGS. 4–6 illustrate the water jet propulsion module **10*a* of a second embodiment of the invention that is provided with a rudder 90 for steering. The module 10*a* is the same as that used in the first embodiment except that the upper and lower portions of the stator housing 12*a* are extended rearwardly to provide tabs 92 to which the vertically oriented rudder 90 is pivotally supported by cap screws 96 or the like. An arm 98 is rigidly secured to the rudder and is pivotally secured to the piston rod 100 of a hydraulic cylinder 102 having its case pivotally connected to a bracket 105 bolted to the mounting flange of the motor Ma. The arm 98, hydraulic cylinder 102 and conduits 104,106 connected to the cylinder are disposed out of the water jet discharge path from the module. As illustrated in FIG. 4, the hydraulic conduits 104,106 extend through openings in the upper stator vane 24*a* and through an opening 108 in the hollow support member 21*a***.

Actuation of the hydraulic cylinder 102 will cause the rudder 90 to pivot through the steering range illustrated in FIGS. 5 and 6. FIG. 6 illustrates the rudder 90 in its full right position indicating that the high speed jets of water from the water jet module **10*a* contacts a full 180° segment of the rudder 90** providing good turning control.

In operation of the water jet module 10 (FIG. 1) of the present invention, at least one module is connected to a powered watercraft (not shown), for example, a military or commercial amphibious vehicle, or a shallow draft watercraft. The hollow support member 21 is mounted on the watercraft with the forward and rear ends of the module 10 being submerged in water and being clear of obstructions on the watercraft thereby providing a substantially linear flow path of water from the inlet end to the discharge end of the module 10. If desired, a hydrafoil 22 may be connected to the module 10.

A power source, such as an engine, in the watercraft then provides power to the motor M which drives the impellers 13. The impeller blades 34 then receive water through the front of the impeller shroud 14 and direct the water as an annulus of water rearwardly between the diffusion cone 16 of the impeller 13 and impeller shroud 14 while using the generally parabolic shape of the diffusion cone 16 and the curvature of the impeller shroud 14 to gradually confine the water into an annulus of gradually decreasing thickness and increasing velocity as the water moves rearwardly concentric with the axis A (FIG. 2). The curved stator vanes 28 serve to convert the vortex flow of the impeller discharge to the pure axial flow desired at the nozzle. Since any tangential flow at the nozzle represents a loss of energy, elimination of said vortex flow is essential to achieve maximum propulsive efficiency. The rate of tangential flow in the vortex is related to static head developed in the impeller. Since the static head is relatively high, the said tangential flow is also high, hence the efficiency improvement by converting vortex flow to axial flow in this application is very significant. Both the interior and exterior surfaces of the module 10 are streamlined and smooth surfaced thereby minimizing drag.

The watercraft may be driven in a reverse direction by reversing the motor M, or motors M when two or more water jet modules are used. High speed steering with two modules may be accomplished by driving the two motors at different speeds. When turning at slow speeds, one motor may be reversed relative to the other motor. Alternately, the rudder 90 of the rudder equipped module 10*a* of the second embodiment of the invention may be used for steering.

From the foregoing description it is apparent that the water jet propulsion module of the present invention minimizes internal flow losses of the module as well as minimizing external drag of the module by providing a substantially straight flow of water from the inlet end to the discharge end of the module. These internal losses and external drag are significantly less than found in prior art. Curved stator vanes substantially minimize the formation of vortexes behind the discharge end of the module.

Although the best mode contemplated for carrying out the present invention has been herein shown and described, it will be apparent that modification and variation may be made without departing from what is regarded to be the subject matter of the invention.

What is claimed is:

1. A water jet propulsion module comprising:

means defining an outer stator housing generated about a central axis and having an inlet end with a parabolic inner surface, an outlet end and a truncated conically shaped inner surface terminating in a conical inner stator surface at said outlet end;

means defining an impeller having a plurality of impeller blades secured to a rotatable generally parabolic impeller diffusion cone disposed within and closely adjacent to said truncated conically shaped inner surface of said stator housing;

means defining an annular inner stator wall having an outer surface closely adjacent to said generally parabolic impeller diffusion cone with said outer surface shaped as a continuation of the surface of said generally parabolic impeller diffusion cone;

means defining a plurality of spaced stator vanes secured between a portion of said outer stator wall and said inner stator wall adjacent said outlet end; and power means secured to said inner stator wall and having a shaft operatively connected to said impeller means for driving said impeller means.

2. An apparatus according to claim 1 and additionally comprising a planetary gear drive operatively connected between said impeller means and said power means.

3. An apparatus according to claim 2 wherein said impeller means, said planetary gear drive, and said power means are removable as a unit from said water jet propulsion module after a portion of said outer stator housing has been removed therefrom.

4. An apparatus according to claim 3 wherein said planetary gear drive is a two-stage planetary gear drive for reducing the speed of said impeller relative to the speed of said power means.

5. An apparatus according to claim 4 wherein said power means is an electric motor.

6. An apparatus according to claim 4 wherein said power means is a hydraulic motor.

7. An apparatus according to claim 1 wherein the length of said water jet propulsion module between said inlet end and said discharge end is less than the diameter of said outer housing means.

8. A water jet propulsion module comprising:

means defining an outer stator housing generated about a central axis and having an inlet end with a parabolic inner surface, an outlet end and a truncated conically shaped inner surface terminating in a conical inner stator surface at said outlet end;

means defining an impeller having a plurality of impeller blades secured to a rotatable generally parabolic impeller diffusion cone disposed within and closely adjacent to said truncated conically shaped inner surface of said stator housing;

means defining an annular inner stator wall having an outer surface closely adjacent to said generally parabolic impeller diffusion cone with said outer surface shaped as a continuation of the surface of said generally parabolic impeller diffusion cone;

means defining a plurality of spaced stator vanes secured between a portion of said outer stator wall and said inner stator wall adjacent said outlet end, said plurality of stator vanes being curved to receive water from said impeller and to straighten the flow of water for discharge from said module in a direction parallel to said central axis;

power means secured to said inner stator wall and having a shaft operatively connected to said impeller means for driving said impeller means.

9. An apparatus according to claim 7 wherein at least one of said stator vanes has a passageway therein for receiving power and control circuits therethrough.

10. A water jet propulsion module comprising:

means defining an outer stator housing generated about a central axis and having an inlet end with a parabolic inner surface, an outlet end and a truncated conically shaped inner surface terminating in a conical inner stator surface at said outlet end;

means defining an impeller having a plurality of impeller blades secured to a rotatable generally parabolic impeller diffusion cone disposed within and closely adjacent to said truncated conically shaped inner surface of said stator housing;

means defining an annular inner stator wall having an outer surface closely adjacent to said generally parabolic impeller diffusion cone with said outer surface shaped as a continuation of the surface of said generally parabolic impeller diffusion cone;

means defining a plurality of spaced stator vanes secured between a portion of said outer stator wall and said inner stator wall adjacent said outlet end;

power means secured to said inner stator wall and having a shaft operatively connected to said impeller means for driving said impeller means; and a rudder pivotally secured to said outer stator housing adjacent said outlet end, and means connected between the rudder and disposed within and connected to a rear portion of said inner stator wall for steering the module when immersed in water.

11. A water jet propulsion module comprising;

means defining annular outer and inner housings generated about a central axis and having an inlet end and an outlet end;

means defining an annular inner stator wall;

means defining a plurality of spaced stator vanes secured between said outer annular housing and said inner stator wall;

means defining a rotatable parabolic impeller diffusion cone having impeller blades projecting outwardly therefrom to a position immediately adjacent to said outer annular housing and conforming to an inner contour of said outer annular housing, said impeller blades having radial lengths less than their axial lengths;

means defining a motor secured to said inner stator wall and having a drive shaft; and means defining a planetary gear drive connected between said shaft and said impeller diffusion cone for driving said impeller when submerged in water causing the water to be drawn into said inlet end and be discharged from said outlet end in a direction parallel to said axis and at high velocity.

12. A water jet propulsion module comprising:

means defining annular outer and inner housings generated about a central axis and having an inlet end and an outlet end;

means defining an annular inner stator wall;

means defining a plurality of spaced stator vanes secured between said outer annular housing and said inner stator wall;

means defining a rotatable parabolic impeller diffusion cone having impeller blades projecting outwardly therefrom to a position closely adjacent to said outer annular housing;

means defining a motor secured to said inner stator wall and having a drive shaft; and means defining a planetary gear drive connected between said shaft and said impeller diffusion cone for driving said impeller when submerged in water causing the water to be drawn into said inlet end and be discharged from said outlet end in a direction parallel to said axis and at high velocity; said vanes being curved to receive vortex water flow from said impeller means and correct the flow to axial flow before water is discharged through said outlet end.

13. An apparatus according to claim 11 wherein said inner annular stator wall is disposed closely adjacent said rotatable impeller diffusion cone and defines a continuation of said parabolic diffusion cone to said outlet end of the module.

14. A water jet propulsion module comprising:

means defining annular outer and inner housings generated about a central axis and having an inlet end and an outlet end;

means defining an annular stator wall;

means defining a plurality of spaced stator vanes secured between said outer annular housing and said inner stator wall wherein at least one of said stator vanes has a passage therein for receiving power and control circuits therethrough;

means defining a rotatable parabolic impeller diffusion cone having impeller blades projecting outwardly therefrom to a position closely adjacent to said outer annular housing;

means defining a motor secured to said inner stator wall and having a drive shaft; and means defining a planetary gear drive connected between said shaft and said impeller diffusion cone for driving said impeller when submerged in water causing the water to be drawn into said inlet end and be discharged from said outlet end in a direction parallel to said axis and at high velocity.

15. A water jet propulsion module generated about a linear axis;

means defining an inner stator housing having a conical inner wall and a cylindrical outer wall;

means defining water straightening vanes between said inner and outer walls;

power means within and removably secured to said inner wall and having a shaft;

means defining a planetary gear drive connected in driven engagement to said motor shaft and removably supported by said inner wall;

means defining an impeller including a parabolic impeller shroud having an annular rear edge defining a continuation of said conical inner wall, said impeller including a plurality of impeller blades having curved outer edges; and means defining an impeller shroud adjustably and removably connected to said cylindrical outer wall of said stator housing and having an inner surface which conforms with the curve of said outer edges of said impeller blades, said impeller shroud being adjustable relative to said curved outer edges to compensate for wear of the said outer edges of said impeller.

16. An apparatus according to claim 15 wherein after removing said impeller shroud from said stator housing; said power means, said planetary gear drive, and said impeller means being removable as a unit from said inner stator housing.

17. An apparatus according to claim 11 wherein said planetary gear drive is a two stage planetary gear drive.

18. An apparatus according to claim 11 and additionally comprising means defining at least two water passages through said annular inner stator wall for directing water around said motor for cooling the motor.

19. A water jet propulsion module comprising:

means defining annular outer and inner housings generated about a central axis and having an inlet end and an outlet end;

means defining an annular inner stator wall;

means defining a plurality of spaced stator vanes secured between said outer annular housing and said inner stator wall;

means defining a rotatable parabolic impeller diffusion cone having impeller blades projecting outwardly therefrom to a position closely adjacent to said outer annular housing;

means defining a motor secured to said inner stator wall and having a drive shaft; and means defining a planetary gear drive connected between said shaft and said impeller diffusion cone for driving said impeller when submerged in water causing the water to be drawn into said inlet end and to be discharged from said outlet end in a direction parallel to said axis and at a high velocity; wherein said means defining said outer annular housing includes a first portion defining an outer annular stator wall having a narrow inlet end portion, a second portion defining an impeller shroud having a narrow end portion slidably received on said narrow inlet end portion, and connector means for adjustably connecting said first and second portions together for allowing removal of said impeller and for compensating for impeller blade wear.

20. An apparatus according to claim 11 wherein said impeller blades are relatively straight for improving efficiency within said propulsion module when said module is immersed in water, is connected to a water craft, and the impeller is driven.

* * * * *